United States Patent [19]

Dickinson et al.

[11] Patent Number: 4,791,731

[45] **Date of Patent: * Dec. 20, 1988**

[54] VERTICAL SURFACE INSTALLING DEVICE

[76] Inventors: John Dickinson, 8400 Flame Vine Ave. N., Seminole, Fla. 33543; Peter Warhurst, 894 Del Robles Dr., Clearwater, Fla. 33546

[ * ] Notice: The portion of the term of this patent subsequent to Jul. 9, 2002, has been disclaimed.

[21] Appl. No.: 139,620

[22] Filed: Dec. 30, 1987

Related U.S. Application Data

[63] Continuation-in-part of Ser. No. 26,473, Mar. 16, 1987, abandoned, which is a continuation of Ser. No. 753,001, Jul. 8, 1985, Pat. No. 4,649,652, which is a continuation-in-part of Ser. No. 582,387, Feb. 22, 1984, Pat. No. 4,527,338.

[51] Int. Cl.[4] ..... B25H 7/00

[52] U.S. Cl. ..... 33/528; 33/138; 33/161; 33/562; 33/384; 33/666

[58] Field of Search ..... 33/138, 161, 562, DIG. 10, 33/528, 613, 376, 370, 384, 385, 666, 669

[56] References Cited

U.S. PATENT DOCUMENTS

| | | | |
|---|---|---|---|
| 618,254 | 1/1899 | Morrison | 33/384 |
| 1,083,997 | 1/1914 | Duffy | 33/376 |

*Primary Examiner*—Harry N. Haroian

*Attorney, Agent, or Firm*—Frijouf, Rust & Pyle

[57] ABSTRACT

A device for installing an article on a vertical surface is disclosed. The device includes a base and a first longitudinal member connected to the base. A second longitudinal member is slidable longitudinally relative the first member. The second longitudinal member is in a telescopic relationship with the first longitudinal member enabling the distal end of the second longitudinal member to be varied in vertical height relative to the base. A template frame is secured to the second member and a plurality of punches are disposed in the frame. The device also includes a lock for locking the relative position between the first and the second longitudinal members, enabling an operator to position the template frame a predetermined distance vertically above the base with the template frame being located in contact with the vertical surface to form an aperture in the vertical surface upon depression of at least one of the plurality of punches to install the article on the vertical surface thereby. The device includes a level correcting means and cutter point(s) which aligned with the measurement indicated by the measuring tape between the first and second rollers to ream a drape bracket support aperture in the vertical support surface in vertical alignment with the measurement indicated by the measuring tape.

6 Claims, 8 Drawing Sheets

VERTICAL SURFACE INSTALLING DEVICE

RELATED APPLICATIONS

This application is a continuation-in-part of our copending application Ser. No. 026,473, filed Mar. 16, 1987, now abandoned, which is a continuation of application Ser. No. 753,001, filed July 8, 1985, now U.S. Pat. No. 4,649,652, which is a continuation-in-part of application Ser. No. 582,387, filed Feb. 22, 1984 now U.S. Pat. No. 4,527,338. Each of the above-cited applications is incorporated by reference as if fully set forth herein.

BACKGROUND OF THE INVENTION

1. Field of the Invention

This invention relates to a device for installing an article on a vertical surface. More specifically, this invention relates to a drapery rod installation device or the like with a level correcting means and cutter point(s) in vertical alignment with an indicated measurement.

2. Information Disclosure Statement

Professional drape hangars, as well as do-it-yourself enthusiasts, have experienced problems associated with the installation of a pair of drape brackets above a window casement. The usual method employed in the hanging of drapes is to measure and mark on the vertical surface the vertical distance from the floor in accordance with to the length of drapes. This operation is repeated on the opposite side of the window casement in order to locate the correct position for the drape bracket. Not only is this prior method of installing drape brackets time-consuming and inaccurate, but usually it is preferable that two persons be employed in the prior method, because it is necessary for one person to measure the vertical distance from the location of the drape bracket while the other person holds a level to insure that the measure is disposed in a vertical position. With the prior method of installation of drape brackets, once the location of the drape bracket has been determined it is then necessary to mark the location of the fixing holes in the drape bracket so that the wall may be drilled in the correct position such that the bracket may be affixed to the wall. A further problem exists in the prior method of installing drape brackets in that it is essential that the distance between brackets be accurately measured to correspond with the required width of the drapes.

The drapery rod installation device of the present invention overcomes the aforementioned inadequacies of the prior art devices by providing an easily used tool which is readily adjustable for the installation of drape brackets which are used for supporting different lengths of drapes and for enabling the operator at the same time to punch a plurality of holes in the wall which correspond with the required configuration of holes as determined by the particular configuration of the drape bracket.

Various prior art devices have been proposed to facilitate the installation of drape brackets or the like. Among such prior art proposals, U.S. Pat. No. 3,724,085 to Wentworth teaches a drapery rod installation template in which a rib is disposed on top of a window casing and a rule is moved horizontally relative the rib until drill guides are located at a proper distance from the edge of the casing. At the correct location of the drill guides a drill bit is inserted through the drill guides and appropriate holes are drilled in the wall for the location and fixing of the drape brackets to the wall. The operation is repeated on the opposite side of the window casing. However, not only does this installation device require a separate operation for drilling of holes in the walls supporting the drape brackets, but also in the window casing is not completely aligned with the floor, the drapes will not hang properly from the drape brackets and support rods.

Similarly, U.S. Pat. No. 2,799,093 to Miller teaches a gauge for hanging window shades. The gauge includes at least two members which are able to slide telescopically relative each other. The members are locked together to form a device of predetermined dimensions to correspond with the width of a drape to be hung. The correctly-adjusted gauge is laid horizontally above the window casing such that the opposite drape brackets may be correctly positioned adjacent the vertical wall above the window. A suitable punch is inserted through the aligned openings in the brackets to indicate the exact positions for the screws which are to support the shade brackets. No means is disclosed in the specification for insuring that the opposite brackets are located at exactly the same vertical height from the floor.

U.S. Pat. No. 3,791,041 to Phillips teaches a shelf marking punch which includes a mobile vertically-disposed frame having a plurality of spring-urged punches for providing holes in a vertical wall to accommodate shelf arrangements employed in residential buildings. No disclosure is made in the specification of a means for adjusting the vertical height of the plurality of punches relative to the vertical wall; therefore, such a device could not be used for the installation of different lengths of drapes.

Additionally, a publication entitled "Kirsch Drapery Hardware Price List," page 49 effective July 16, 1983 and "Kirsch Drapery Hardware" general catalog copyright 1977 page 48 show a device for enabling the hanging of drapes including a template for assisting the correct location of a drapery bracket. However, neither of these Kirsch publications disclose a plurality of punches disposed in the frame or template.

Although the prior art drape hanging devices produce an improvement when compared with the more conventional methods of installation using a ruler and level, nevertheless a need has existed in the art of a simple device which would enable an operator to install a drape bracket quickly and easily at the correct location and to insure that such bracket is positioned laterally at exactly the same vertical position as a bracket installed on the opposite side of the window.

It is the primary object of the invention to provide an adjustable device for the installation of drapes that overcomes the aforementioned inadequacies of the prior art devices and provides an improvement which significantly contributes to the speed and the ease with which an operator may install drape brackets or the like.

Another object of the invention is the provision of a device for installing drapery rods in which the device can be adjusted to accommodate a plurality of drape lengths.

Another object of the present invention is the provision of a device which not only locates the exact vertical position for the drape bracket but also enables the operator to simultaneously punch a hole in the vertical surface in readiness for the installation of the drape bracket.

Another object of the invention is the provision of a device for installing an article on a vertical surface in which an optical linear measure is pivotally mounted on the device to enable the drape bracket to be located in the correct lateral position relative the window.

Another object of the invention is the provision of a device for the installation of an article on a vertical surface in which the device incorporates an adjustment means to adjust the spirit level to insure that the device is held in a vertical disposition relative the vertical surface.

Another object of the invention is the provision of a device which includes a level correcting means to ensure vertical positioning of the drapery hardware relative to a horizontal surface, such as a floor or ceiling.

Another object of the invention is the provision of a device which provides cutter point(s) which aligned with the measurement indicated by a measuring tape between a first and second rollers to ream a drape bracket support aperture in the vertical support surface in vertical alignment with the measurement indicated by the measuring tape.

Another object of the invention is provision of a device for installing an article on a vertical surface, including a base and a first and a second longitudinal member, the longitudinal members being slidable telescopically relative each other and a template frame secured to the distal end of the second longitudinal member, the template frame including a plurality of punches disposed in a pattern which corresponds with the fixing holes disposed in all the various currently available drapery support brackets.

Another object of the present invention is to the provision of a device for installing a drapery bracket on a vertical surface the device including a retractable measuring tape and a finger-actuated locking means for locking the tape anywhere between a first retracted disposition to a second fully extended lateral position relative to the first longitudinal member.

Another object of the present invention is the provision of a device for installing a drapery bracket on a vertical surface, the device including a pair of guide rollers for guiding the tape between a stop member and the first end of a spring biased pivotally disposed arm such that the tape may be locked at any desired lateral disposition.

Another object of the present invention is the provision of a device for installing a drapery bracket on a vertical surface, the device including an L-shaped member which is secured to the extendable end of the tape such that the L-shaped member may be hooked over an edge of the vertical surface.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Particularly with regard to the use of the invention disclosed herein, this should not be construed as being limited to devices for installing articles on a vertical surface, but should include drapery rod installation devices for handling picture frames and the like.

SUMMARY OF THE INVENTION

The present invention is defined by the appended claims with the specific embodiment shown in the attached drawings. For the purpose of summarizing the invention, the invention relates to an improved device for installing an article on a vertical surface. The invention comprises a base with a first longitudinal member connected to the base and a second longitudinal member slidable longitudinally relative to the first member. Means are used for establishing the second longitudinal member in a telescopic relationship with the first longitudinal member enabling the distal end of the second longitudinal member to be varied in vertical height relative to the base. A template frame is secured to the second member. A plurality of punches are disposed in the frame. A mounting plate having a first end and a second end with the first end is slidably and pivotally secured to the first longitudinal member. A retractable measuring device is connected to the mounting plate for measuring laterally relative to the first longitudinal member. A spirit level is secured to the first end of the mounting plate for permitting in use the ascertainment and maintenance of the device in a vertical position. Adjusting means for adjusting the level corrects the level for error such that in use the longitudinal members are vertically positioned on the vertical surface. Locking means for locking the relative position between the first and the second longitudinally extending members, enables an operator to position the template frame a predetermined distance vertically above the base with the template frame being located in contact with the vertical surface to form an aperture in the vertical surface upon depression of at least one of the plurality of punches to install the article on the vertical surface thereby.

Preferably, the mounting plate includes a first side and a second side and the adjusting means comprises a frist and a second adjustment screw positioned at the first side and the second side of the second end of the mounting plate, respectively. The first longitudinal member is positioned between the first and the second adjustment screws such that in use upon rotation of each of the adjustment screws in a first direction the first longitudinal member is abutted by each the adjustment screws thereby securing the mounting plate to the first longitudinal member. Upon rotation of each the adjustment screws in a second direction each of the adjustment screws is withdrawn from the first longitudinal member to enable the mounting plate to slide along the first longitudinal member and to pivot about the first end for correcting the level relative to the horizontal surface. Once the correction has been made the mounting plate is secured to the first longitudinal member to retain the position of the level.

In a further embodiment the retractable measuring device further includes a tape measure secured to the mounting plate. The tape measure includes a spindle and a length of measuring tape having a first end secured to the spindle and an extendable end such that the tape is coiled around the spindle. First biasing means for recoiling the tape from a first position in which the tape is extended away from the spindle to a second position in which the tape is recoiled around the spindle is used. A finger-actuated locking means is secured to the plate for locking the tape anywhere between the first and the second position. The finger-actuated locking means includes a locking arm having a first and a second end, the arm being pivotally secured to the plate between the first and second ends of the arm. A stop member is rigidly secured to the plate adjacent to the first end of the arm. Second biasing means is disposed adjacent to the second end of the arm for pivoting the first end of the arm into abutment against the stop member. Guide means is disposed adjacent the first end of the arm for guiding the tape from the spindle between the stop member and the first end of the arm. The guide means includes a first and a second roller each having the axis of rotation which is spaced and parallel relative to each other such that the tape simultaneously engages the first and the second roller and extends between the rollers for guiding the tape in a first lateral direction when the tape passes around the first roller and in a second lateral direction opposite to the first direction when the tape passes around the second roller. A reamer extends from each punch of the plurality of punches, with the end of each reamer defining a cutter point. The first and second rollers are positioned on the mounting plates such that the position of the tape between the first and the second rollers is in alignment with at least one the cutter point of the reamer extending from each the punch of the plurality of punches disposed in the frame. Thus, in use the cutter point is aligned with the measurement indicated by the measuring tape between the first and the second rollers to ream a drape bracket support aperture in the vertical support surface in vertical alignment with the measurement indicated by the measuring tape between the first and the second rollers. The second end of the arm is finger-actuable such that when the second end of the arm is pivoted against the second biasing means, the tape is extendable away from the spindle and when the second end of the arm is released, the second biasing means pivotally urges the first end of the arm against the tape to lock the tape between the stop member and the first end of the arm.

The tape measure also includes an L-shaped member secured to the extendable end of the tape such that the L-shaped member enables the extendable end of the tape to be hooked over an edge of the vertical surface. More particularly, the L-shaped member includes a first and a second arm disposed at right angles to each other with the first arm being secured to the extendable end of the tape. The second arm is hooked over the edge of the vertical surface and the second arm includes a spike which extends from the second arm towards the first are for enabling the second arm to engage the edge of the vertical surface.

The foregoing has outlined rather broadly the more pertinent features of the present invention in order that the detailed description of the invention that follows may be better understood so that the present contribution to the art can be more fully appreciated. Additionally, features of the inventions will be disclosed or described hereinafter which form the subject of the claims of the invention. It should be appreciated by those skilled in the art that the conception and specific embodiments disclosed may be readily utilized as a basis for modifying or designing other devices for carrying out the same purposes of the present invention. It should be realized by those skilled in the art that such equivalent constructions do not depart from the spirit and scope of the invention set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 1:
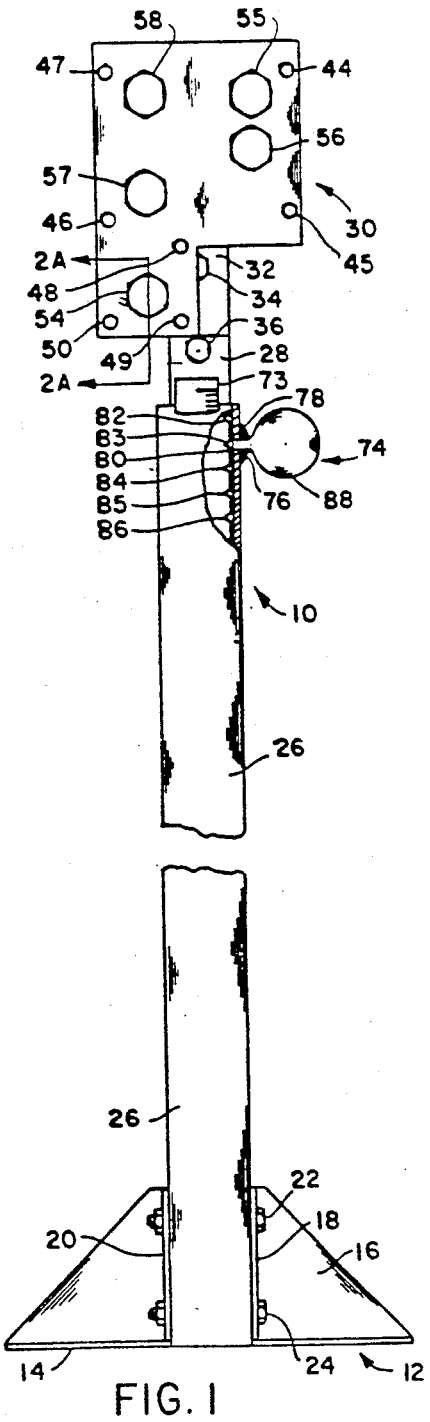
FIG. 1 is a front elevational view of the drapery rod installation device of the present invention.

FIG. 1 is a front elevational view of the device generally designated 10 for installing an article on a vertical surface. The device 10 includes a base generally designated 12. The base 12 includes a planar portion 14 which cooperates with and extends substantially horizontally relative a horizontal surface, such as a floor or ceiling. An upstanding portion 16 of generally trapezoidal configuration extends angularly relative the planar portion 14. A pair of spaced supports 18 and 20, respectively, are spaced parallel relative each other and extend from the upstanding portion 16. Anchoring bolts 22 and 24, respectively, extend through the spaced supports 18 and 20 to anchor a first longitudinal member 25 between the supports 18 and 20 such that the first longitudinal member 26 extends substantially relative the planar portion 14.

A second longitudinal member 28 is slidable longitudinally relative the first member 26. The first longitudinal member 26 is preferably of substantially square, tubular cross sectional configuration, the internal transverse cross-sectional area of the first member 26 being slightly greater than the external square cross-sectional area of the second member 28, such that the second member 28 may slide longtudinally relative to the within the first longitudinal member 26. Because of the first and second members 26 and 28 respectively are substantially squire in transverse cross-sectional area, the second member 28 is provided from rotating axially within the first longitudinal member 26. A template frame generally designated 30 is rigidly connected to the distal end 32 of the second member 28 by means of two fastening devices 34 and 36, respectively. The template frame 30 includes a planar support 38, and impact plate 40, and a connector plate 42. The plates 38, 40 and 42 are connected together in juxta-disposition parallel relative each other by means of threaded fasteners 44 and 50. The planar support plate 38 and impact plate 40 define a plurality of bores, one of which is shown and designated 52, as shown in FIG. 2 and FIG. 2A.

The longitudinal axis of each of the bores is normal to the planar plate 38. A plurality of punches 54 and 58 are slidably received within the bores within the planar support plate 38. The connecting plate 42 is preferably faced with a strip of felt 43 and is connected to the planar plate 38 and the distal end 32 of the second member 28, such that the strip of felt 43 rests against and is a cushioning means to protect the vertical surface when the template frame 30 is pressed against the vertical surface.

Figure 2:
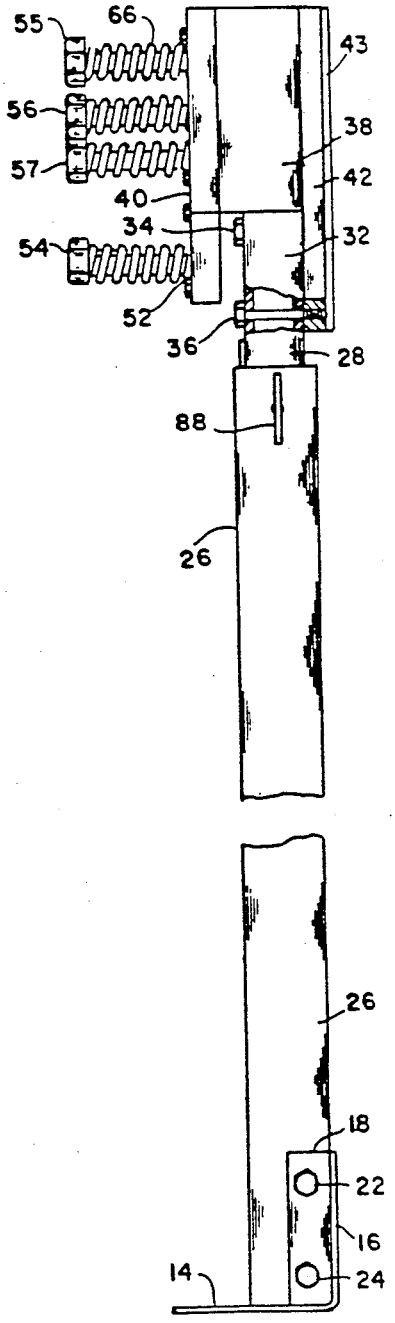
FIG. 2 is a right side elevational view of the device shown in FIG. 1.
Figure 2A:
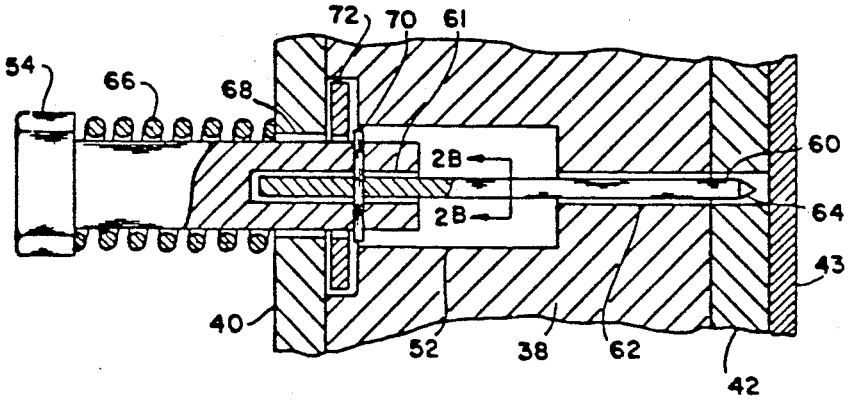
FIG. 2A is an enlarged sectional view of one of the reamers taken on the line 2A—2A of FIG. 6.

The punches 54 and 58 each include a reamer, one of which is designated 60, and is shown in FIG. 2 and FIG. 2A as extending from the punch 54. The reamer 60 extends normal to the planar plate 38 through a counterbore 62 defined by the planar plate 38 and the connector plate 42 and the felt 43. The reamer 60 includes a cutter point 64 defined by the distal end of the reamer 60. The cutter point 64, cooperating with the vertical surface to ream a drape bracket support aperture/hole therein. A compression spring 66 biases the punch 54 into a non-operative position with the cutter point 64 retracted from the vertical surface. As shown in FIG. 2 and FIG. 2A, a secondary bore 68 defined by the impact plate 40 is aligned with, and is of the same dimensions as, the bore 52 such that the punch 54 may move longitudinally through the bores 68 and 52. A stop pin 70 extends transversely through the punch 54 to arrest the biased movement of the punch 54 away from the vertical surface. The stop pin 70 abuts against a washer 72 disposed coaxially with the reamer 54 and is located between the impact plate 40 and the planar plate 38.

A metal rule 73 is riveted or otherwise permanently attached to the front face of the second longitudinal member 28 such that the distance between the planar portion 14 and the base 12 and the various sets of reamers can be calibrated for a particular height of drapery to be installed.

Figure 2B:
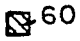
FIG. 2B is a sectional view of one of the reamers taken on the like 2B—2B of FIG. 2A.

FIG. 2B is a sectional view of the reamer 60 which is substantially of square transverse cross-sectional configuration. The reamer 60 may be removed and replaced by the removal of the pin 70 which locks the reamer 60 within a bore 61 defined by the reamer 54.

A locking device generally designated 74 includes a tumbler 76 which is biased by a spring 78 to urge the tumbler 76 transversely through a hole 80 defined by the first member 26, such that the tumbler 76 engages one of a plurality of indentations 82 to 86 defined by and spaced along the length of the second member 28. A finger-actuated handle 88 is rigidly connected to the tumbler 76 for permitting the tumbler 76 to be pulled out of engagement with the indentations 82 to 86 to adjust the predetermined distance of the template frame 30 from the base 12.

Figure 3:
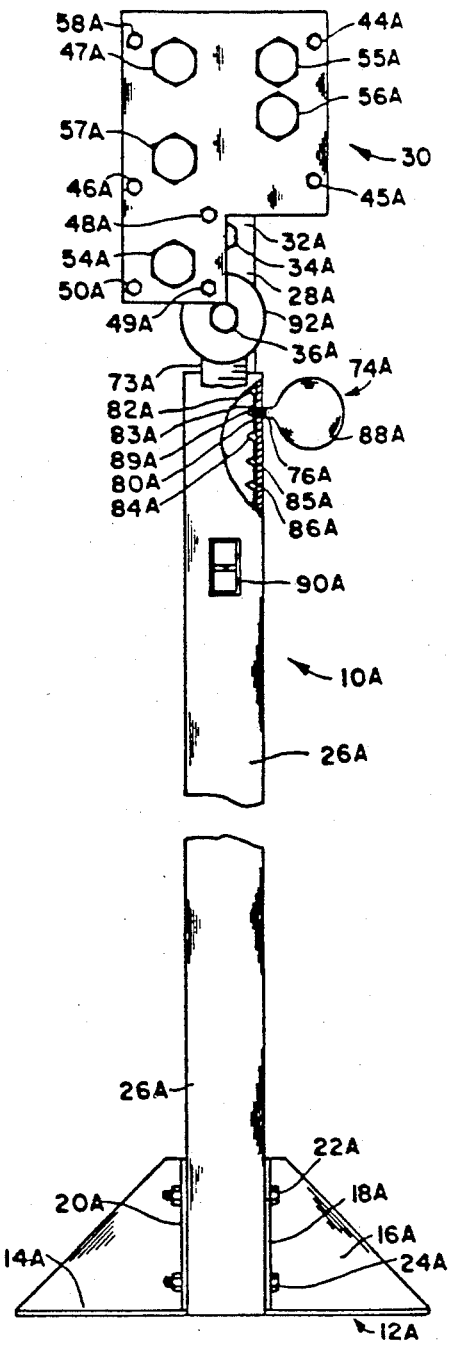
FIG. 3 is a front elevational view of an alternative embodiment of the device shown in FIG. 1.

In an alternative embodiment of the present invention as shown in FIG. 3, similar parts are reffered to with the corresonding similar numeral to those of the foregoing embodiments, together with the suffix A. In the alternative embodiment shown in FIG. 3, the locking means 74A includes a rod 76A, which threadably engages and corporates with a threaded bore 80A defined by the first longitudinal member 26A. By turning the finger-actuated device 88A the distal end 89A of the pin 76A is urged into contact with one of the indentations 82A to 86A to lock the first and the second members 26A and 28A together such that the template frame 30A is fixed at a predetermined vertical distance relative the base 12A.

Additionally, in the alternative embodiment as shown in FIG. 3, a spirit level 90A is connected to the first longitudinal member 26A for maintaining the member 26A in a vertical position relative the vertical surface during the installation procedure.

In addition to the spirit level 90A a linear scale such as a flexible extending metallic rule having a scale printed thereon is designated 92A. The scale or rule 92A is pivotally connected to the second member 28A. The scale or rule 92A is pivotally connected to the second member 28A such that the rule 92A pivots or rotates around the bolt 36A. With this arrangement, the scale means 92A may be pivoted about the second member 28A such that when the device 10A is positioned on one side of the window the scale 92A may be extended laterally relative the device 10A to measure a lateral distance from the device 10A.

Figure 4:
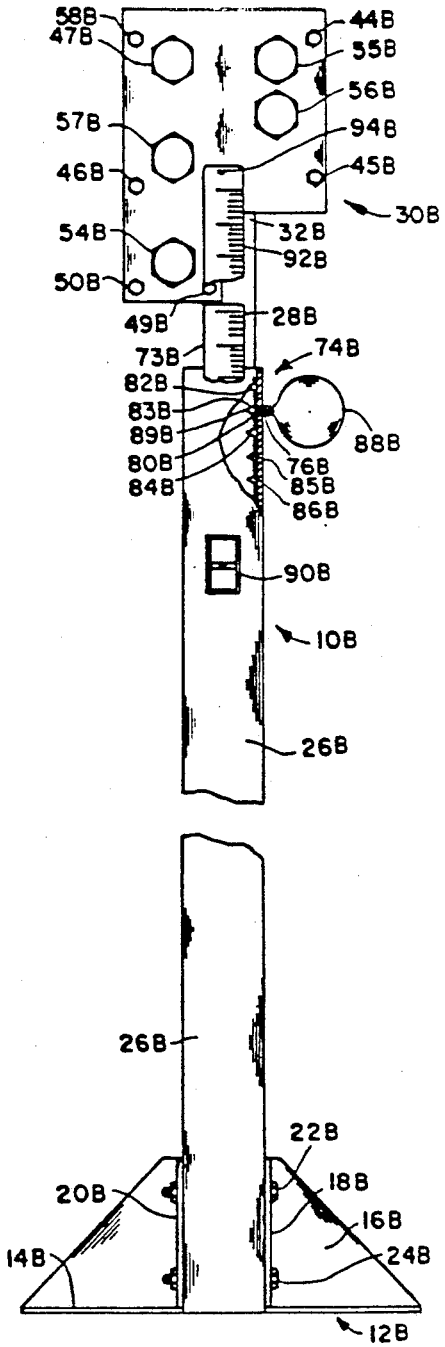
FIG. 4 is a front elevational view of a further alternative embodiment of the device shown in FIG. 1.

In a further alternative embodiment of the present invention as shown in FIG. 4, the scale means 92B is a rigid linear measure which is pivotally connected about a pivot pin 94B such that the scale means 92B may be pivoted laterally relative the device 10B in either direction to measure a distance laterally relative the distance 10B.

Figure 5:
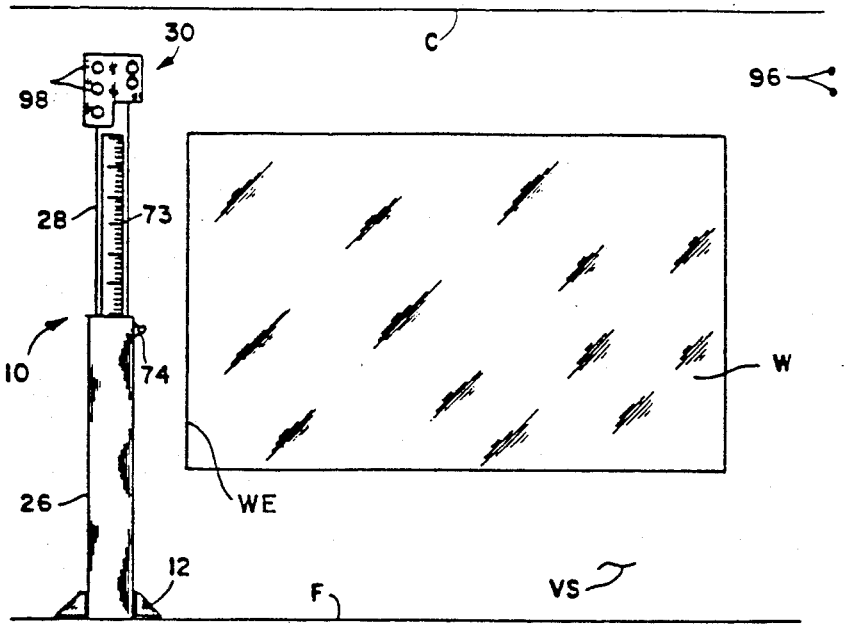
FIG. 5 is a diagrammatic representation of the device shown in FIG. 1 when used to install a drape bracket adjacent a window.

FIG. 5 is a diagrammatic representation of the device 10 when used to install a pair of drape-supporting brackets to a vertical surface. The vertical surface in FIG. 5 is represented by the letters VS; the floor is represented by the letter F; the window is represented by the letter W; and the ceiling is represented by the letter C. In operation of the device 10 as shown in FIG. 5, the device 10 is placed with the base 12 adjacent the floor F, and the first set of holes 96 corresponding with the holes in the drape bracket to be used are punched in the vertical surface on the right hand side of the window W. The device 10 is then moved to the position as shown in FIG. 5 with the device located to the left of the window W, and a second set of holes 98 are punched in the vertical surface VS at exactly the same height vertically from the floor F as the first set 96. If the device is then used for installing drape brackets of a different hole configuration adjacent another window, the same operation is repeated, but using a different combination of the punches 54 to 58 to correspond with the holes in the required bracket.

If the drape to be installed at another window is of a different length, then the lock 74 is released to permit the template frame 30 to be moved vertically to the required disposition of the template relative to base 12.

FIGS. 6–15 show a further embodiment of the present invention including a retractable measuring device connected to the first longitudinal member for measuring laterally relative to the first longitudinal member. More specifically, FIGS. 6–15 show a device which is identical to the embodiment shown in FIGS. 1–5 except in that the template frame is rectangular, the locking device is spherical and the first longitudinal member includes a retractable measuring device secured there to, as described hereinafter.

The same numerals shown in FIGS. 6–15 refer to similar parts to those shown in the embodiments of FIGS. 1–5 however, the suffix C has been added thereto.

Figure 6:
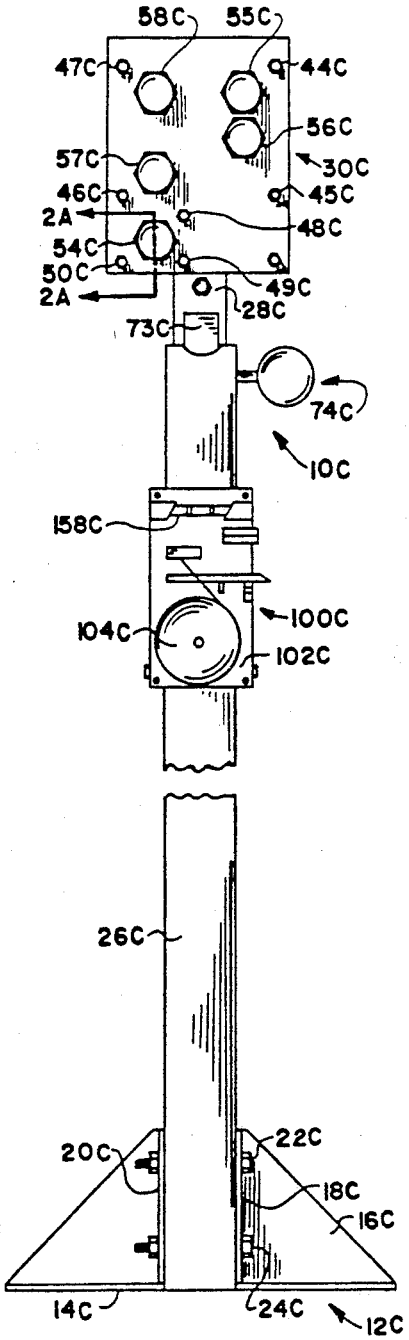
FIG. 6 is front elevational view of a further embodiment of the present invention including a retractable measuring device connected to the first longitudinal member.
Figure 7:
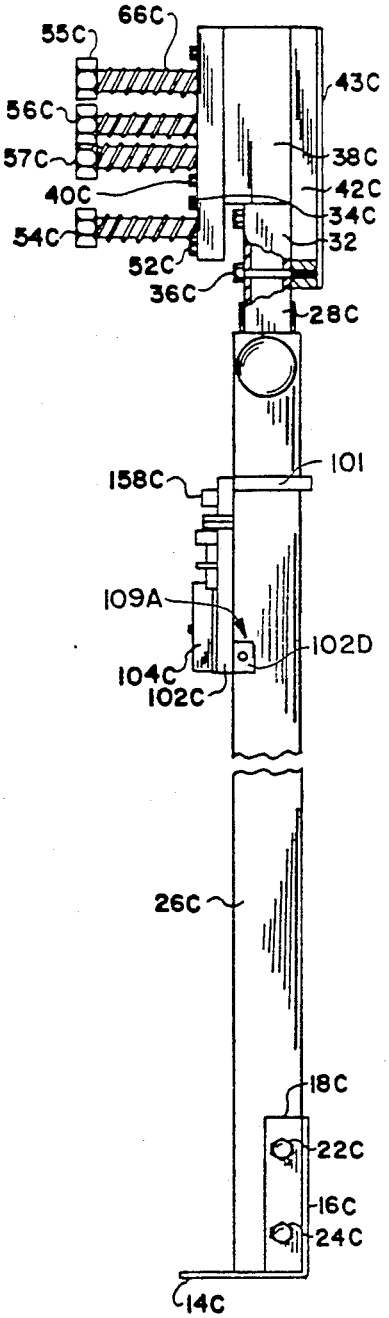
FIG. 7 is a right side elevational view of the device shown in FIG. 6.

FIG. 6 is a front elevational view of an improved drapery rod insulation device generally designated 10C. The device 10C includes a first longitudinal member 26C. A retractable measuring device generally designated 100C is connected to the first longitudinal member 26C between the base 12C and the locking device 74C. The retractable measuring device 100C enables an operator to measure laterally relative to the first longitudinal member 26C. Preferably the measuring device 100C is a tape measure. The measuring device 100C extends and retracts relative to the first longitudinal member 26C and is lockable anywhere between an extended and a retracted disposition thereof. The measuring device 100C also includes a mounting plate 102C which is rigidly secured to the first longitudinal member 26C. A tape measure 104C is secured to the mounting plate 102C. The tape measure 104C includes a spindle 106C shown in FIG. 8 and a length of measuring tape 108C having a first end 110C which is secured to the spindle 106C. The tape 108C is coiled around the spindle 106C and includes an extendable end 112C disposed at the opposite end relative to the first end 110C. A first biasing means 114C, shown more particularly in FIG. 8, recoils the tape 108C from a first position in which the tape 108C is extended away from the spindle 106C to a second position in which the tape 108C is recoiled around the spindle 106C. A finger-actuated locking means generally designated 116C is secured to the plate 102C for locking the tape 108C anywhere between the first and the second position.

The finger-actuated locking means 116C includes a locking arm 118C having a first and a second end 120C and 122C respectively. The arm 118C includes a pivot 124C which is secured to the plate 102C between the first and the second ends 120C and 122C. A stop member 126C is rigidly secured to the plate 102C adjacent to the first end 120C of the arm 118C and a second biasing means 103C is disposed adjacent to the second end 122C of the arm 118C for pivoting the first end 120C of the arm 118C into abutment against the stop member 126C.

A guide means generally designated 132C is disposed adjacent to the first end 120C of the arm 118C for guiding the tape 108C from the spindle 106C between the stop member 126C and the first end 120C of the arm 118C. The second end 122C of the arm 118C is finger-actuatable such that when the second end 122C of the arm 118C is pivoted against the second biasing means 130C, the tape 108C is extendable away from the spindle 106C. When the second end 122C of the arm 118C is released, the second biasing means or compression spring 130C pivotally urges the first end 120C of the arm 118C against the tape 108C to lock the tape 108C between the stop member 126C and the first end 120C of the arm 118C.

Figure 8:
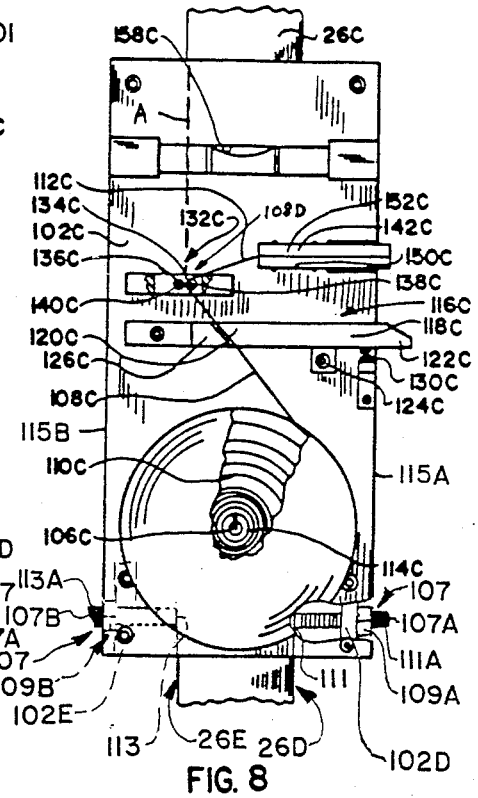
FIG. 8 is an enlarged front elevational view of the retractable measuring device shown in FIG. 6.
Figure 12:
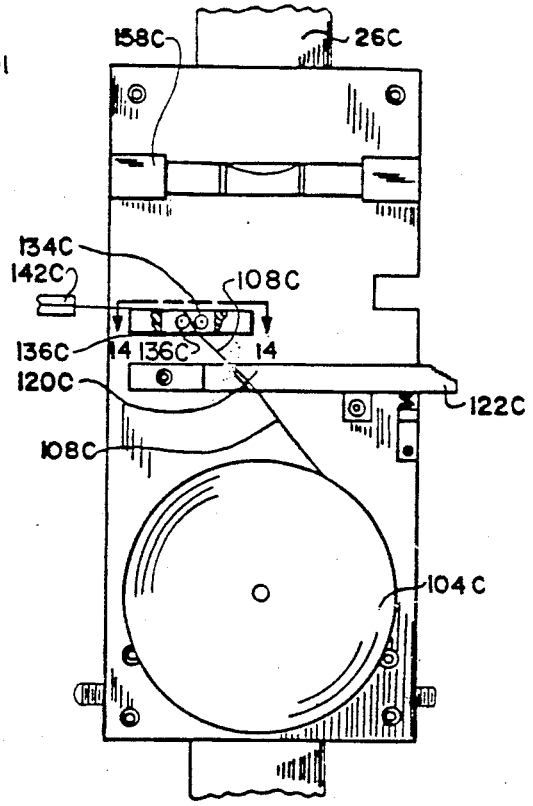
FIG. 12 is a similar view of that shown in FIG. 8 but shows the tape being extended laterally to the left.

As shown more particularly in FIGS. 8, 11, 12, 14 and 15 the guide means 132C includes a first and a second roller 134C and 136C respectively. The rollers 134C and 136C each have an axis of rotation 138C and 140C respectively such that the axes 138C and 140C are spaced only to enable the passage of tape 108C between rollers 134C and 136C and parallel relative to each other so that when the tape 108C extends between the rollers 134C and 136C, the tape 108C is guided in a first lateral direction when the tape passes around the first roller 134C as shown in FIG. 8 and in a second lateral direction opposite to the first direction as shown in FIG. 12 when the tape 108C passes around the second roller 136C. Each roller 134C and 136C preferably simultaneously engages the tape 108C such that the position of the tape in the rollers is in alignment with at least one cutter point 64 of each punch of the plurality of punches 54–58.

Figure 9:
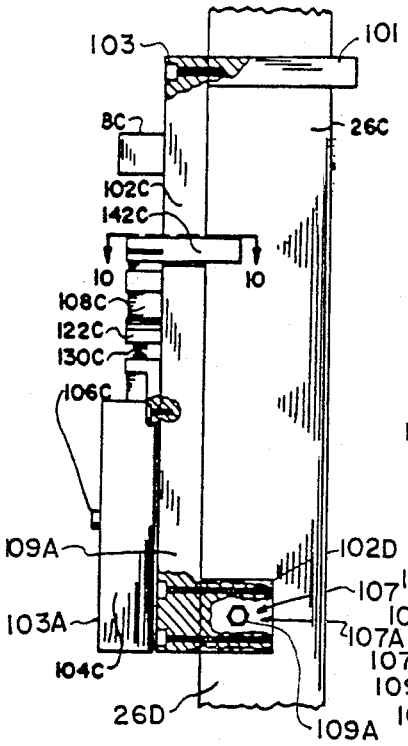
FIG. 9 is a right side elevational view of the measuring device shown in FIG. 8.
Figure 10:
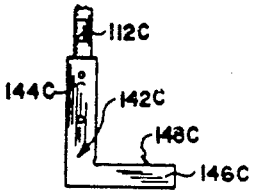
FIG. 10 is a view taken on the line 10—10 of FIG. 9 and shows the L-shaped member.
Figure 11:
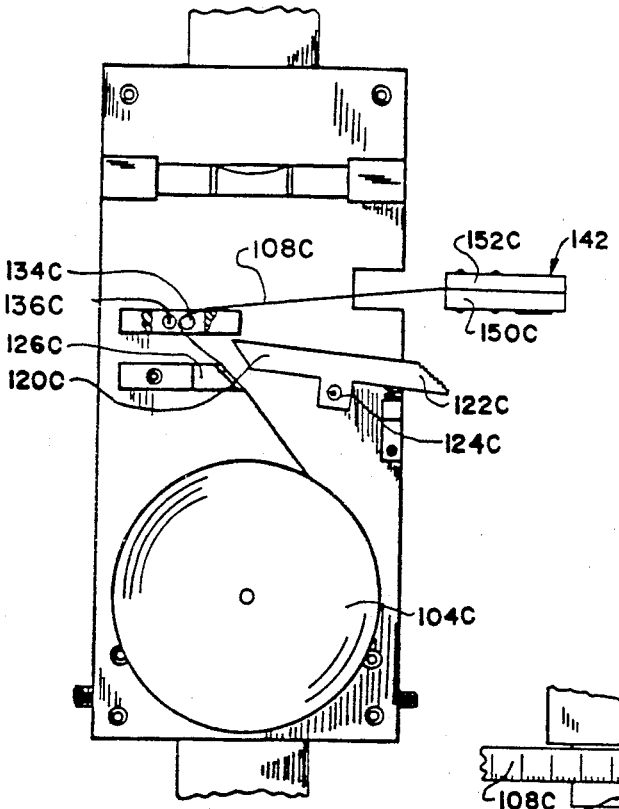
FIG. 11 is a similar view of that shown in FIG. 8 but shows the arm depressed for permitting the tape to be extended.
Figure 14:
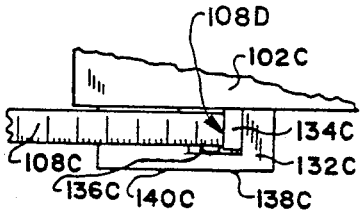
FIG. 14 is a view taken on line 14—14 of FIG. 12.
Figure 13:
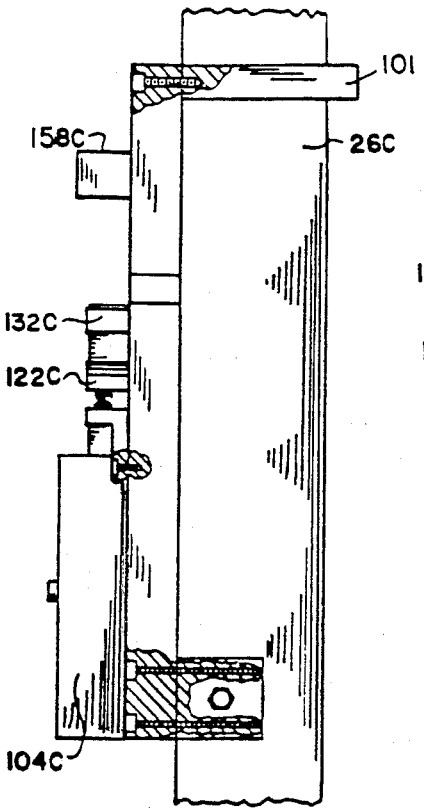
FIG. 13 is a similar view of that shown in FIG. 9 but shows the tape extended to the left as shown in FIG. 12.

As shown in FIGS. 8, 9 and 10, the tape measure 108C also includes an L-shaped member 142C which is secured to the extendable end 112C of the tape 108C such that the L-shaped member 142C enables the extendable end 112C of the tape 108C to be hooked over an edge of the vertical surface VS. More specifically, the L-shaped member 142C includes a first and a second arm 144C and 146C respectively which are disposed at right angles relative to each other. The first arm 144C is secured to the extendable end 112C of the tape 108C and the second arm 146C is hooked over the edge of the vertical surface VS. The second arm 146C also includes a spike 148C which extends from the second arm 146C towards the first arm 144C for enabling the second arm 146C to engage the edge of the vertical surface VS. As shown in FIG. 8, the L-shaped member 142C includes two identical portions 150C and 152C which are secured to each other by rivets 154C and 156C or the like such that the extendable end 112C of the tape 108C is secured to and extends between the two L-shaped portions 150C and 152C respectively.

In a further embodiment, the mounting plate 102C is pivotally secured to the first longitudinal member 26C. The mounting plate 102C further includes a first end 103 and a second end 103A. Preferably, the first end 103 of the mounting plate 102C is slidably received on and pivotally attached to the first longitudinal member 26C. As illustrated, the first end 103 of the mounting plate 102C is slidably secured upon the first longitudinal member 26C by a U-shaped clamp 101 which together with the mounting plate, encircles the first longitudinaly member 26C. Preferably, the second end 103A of the mounting place 102C includes an adjusting means 107 for adjusting level 158C against another level positioned on the first longitudinal member 26C in order to true level 158C, i.e. to correct level 158C for error, which may become out of level during mishandling or dropping the device 10. The maintenance of the vertical positioning of the device 10 is corrected by first positioning the device 10 in a vertical position as indicated by level 158C. A second level is then positioned against the device and the readings of the levels are compared. If needed, the level 158C is brought into agreement with the second level by means 107. The adjusting means 107 allows the second end 103A of the mounting plate 102C to pivot either to the right or left when viewed at FIG. 6, about the first end 103 of the mounting plate 102C thereby enabling the correction of level 158C. The mounting plate is secured to the first longitudinal member 26C at the first end 103 by U-shaped member 101 and at the second end 103A by the adjustment screws 107A,107B which securely abut the member 26C. Preferably, the adjusting means are a first 107A and a second 107B adjustment screw positioned at the first side 115A and the second side 115B of the second end 103A of the mounting plate 102C, respectively, as shown in FIG. 8. The adjusting screws 107A,107B are threadably received in a first 102D and second 102E extension of mounting plate 102C. In this position the first side 26D of first longitudinal member 26C is engaged by first adjustment screw 107A and the second side 26E of first longitudinal member 26C is engaged by second adjustment screw 107B. The first 107A and second 107B adjustment screws further include a first 109A and a second 109B lock nut which prevents rotation of the adjustment screws 107A, 107B once adjusted to true level 158C and/or to enable the slidable repositioning of mounting plate 102C along the first longitudinal member 26C. Each adjustment screw 107A,107B includes a first end 111,113 and a second end 111A,113A such that upon rotation of the adjustment screws in a first direction the first longitudinal member 26C is abutted by each first end 111,113 of each of the adjustment screws 107A, 107B. Once each of the first ends 111,113 have abutted the first longitudinal member 26C, the mounting plate 26C is secured to the first longitudinal member 26C. Upon rotation of the adjustment screws in a second direction each first end 111,113 of each of the adjustment screws 107A, 107B is withdrawn from the first longitudinal member 26C to enable the mounting plate 102C to pivot about the first end 103 and slide along member 26C. Other adjustment means include the substitution of a spring for one of the adjustment screws which would also allow the mounting plate to move or slide along the first longitudinal member.

As shown in FIGS. 6, 8, 11 and 12, the measuring device 100C also includes a spirit level 158C which is rigidly secured to the plate 102C for enabling the first longitudinal member 26C to be positioned parallel to the vertical surface VS.

As will be appreciated by those skilled in the art, the plurality of punches 54C–58C are disposed in a configuration to accommodate a plurality of currently available drape brackets upon punching selected ones of the plurality of punches.

Additionally, a method of installing an article on a vertical surface not only includes positioning the base on a floor relative the vertical surface but also includes positioning the base on any horizontal surface such as a ceiling or the like with the base disposed adjacent to the vertical surface and with the first longitudinal member depending vertically from the base.

In operation of the modified installation device, when the base has been correctly positioned adjacent the floor or ceiling, the alignment of the first longitudinal member 26C is adjusted by the spirit level 158C until the member 26C is disposed spaced and parallel to relative to the vertical surface VS. A plurality of holes are punched in the vertical surface such that the holes correspond with the particular type of drapery bracket being used. The L-shaped member 124C is then pulled laterally either to the left or to the right as required in order to measure the correct position for the location of the installation device on the opposite side of the window W. The spike 148C enables the L-shaped member 142C to be hooked around the adjacent vertical edge of the window W. The tape 108C is locked in the extended disposition thereof by the interaction of the first end 120C and the stop member 126C.

Figure 15:
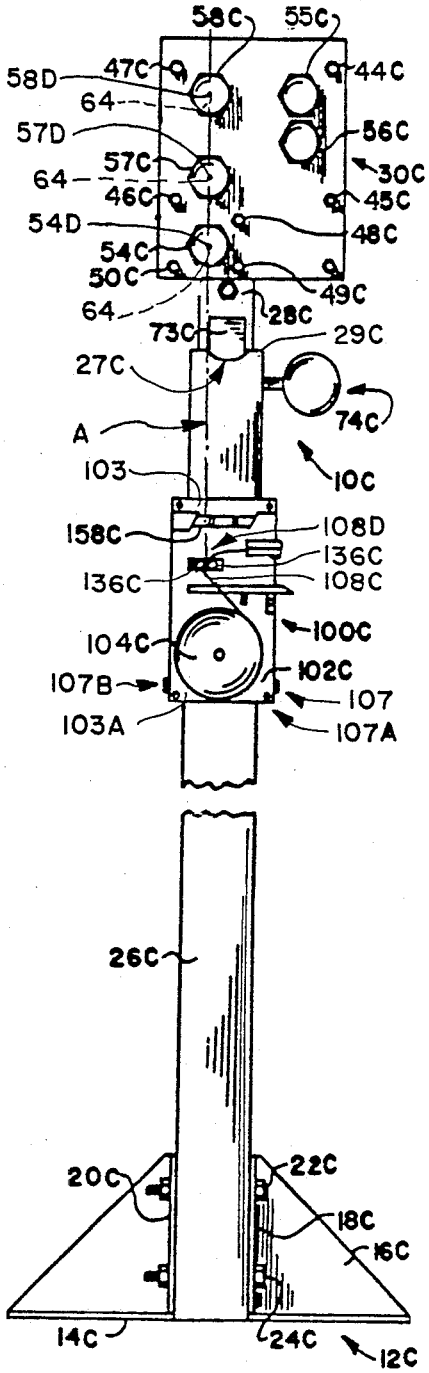
FIG. 15 is a front elevational view of a further embodiment of the present invention including cutter points in alignment with the point of measurement of the measuring tape of a retractable measuring device connected to the first longitudinal member.

FIG. 15 illustrates the first 134C and second 136C rollers positioned on the mounting plate 102C such that the point of measurement 108D of the measuring tape 108C or the position of the tape 108C between the first 134C and second 136C rollers is in alignment with at least one cutter point(s) 64 of the reamer 60 extending from each punch 54C–58C of the plurality of punches 54C–58C disposed in the frame 30C as indicated by alignment line "A". The mounting plate of FIG. 15 includes three punches 54C, 57C and 58C positioned along alignment line "A". FIG. 2A illustrates punch 54C, however punches 57C and 58C are similar. Thus, the plane of the paper of FIG. 2A is the plane of alignment line "A" indicating cutter point 64 is in the plane of alignment line "A" and with center point 54D, 57D and 58D of punches 54C, 57C and 57C, respectively. With the tape 108C positioned between the rollers in alignment with the cutter point enables the cutter point 64 to be simultaneously aligned with the measurement 108D indicated by the measuring tape 108C between the first 134C and the second 136C rollers. Therefore, upon impacting the punch(s) 54C, 57C, 58C reams a drape bracket support hole in the vertical support surface in vertical alignment with the measurement 108D indicated by the measuring tape 108C between the first and the second rollers. The alignment of the cutter point with the tape measure positioned between the rollers enables an accurate alignment of the drapery hardware relative to the lateral distance the drapery is set back from the window opening. Thus, in use one must first determine the distance the drapery hardware is to be set back from the vertical edge WE of the window by the use of tape 108C and determine the distance to be set above a horizontal surface, such as a floor or the like by manipulating the height of the mounting plate by moving the second longitudinal member to result in a position of the device 10 as illustrated at FIG. 5. Once positioned, and after ensuring that the device is vertical by viewing level 158C one merely has to impact the specific punches desired based on the particular hole configuration of the hardware being used to properly align the hardware relative to the distance from the edge of the window.

A metal rule 73C permanently attached to the front face of the second longitudinal member 28C such that the distance between the planar portion 14C and the base 12C and the various sets of reamers can be calibrated for a particular height of drapery to be installed. Preferably, the first longitudinal member 26C includes a measurement notch 27C positioned at the terminal end 29C to enhance the ease of reading the measure indicated by the metal rule 73C.

The present invention provides a device for installing drapery rods and the like to a vertical surface that is not only very simple to operate but also enables the operator to install drape rods at a plurality of vertical heights to accommodate drapes of varying lengths. The device of the present invention also provides means for punching holes in the vertical surface in an appropriate configuration to correspond with currently available drape brackets. The device is simple to use and is of rugged construction and has been demonstrated to greatly increase the speed with which professional installers of window drapes can install drape brackets in order to hang drapes therefrom.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of the construction and the combination and arrangement of parts may be restored to without departing from the spirit and scope of the invention.

What is claimed is:

1. A device for installing an article on a vertical surface, said device comprising:

a base;

a first longitudinal member connected to said base;

a second longitudinal member slidable longitudinally relative said first member;

means for establishing said second longitudinal member in a telescopic relationship with said first longitudinal member enabling the distal end of said second longitudinal member to be varied in vertical height relative to said base;

a template frame secured to said second member;

a plurality of punches disposed in said frame;

a mounting plate having a first end and a second end with said first end being slidably and pivotally secured to said first longitudinal member;

a retractable measuring device connected to said mounting plate for measuring laterally relative to said first longitudinal member;

a spirit level secured to said first end of said mounting plate for permitting in use the ascertainment and maintenance of the device in a vertical position;

an adjusting means for adjusting said level in order to correct said level for error such that in use said longitudinal members are vertically positioned on the vertical surface; and locking means for locking the relative position between said first and second longitudinally extending members, enabling an operator to position said template frame a predetermined distance vertically above said base with said template frame being located in contact with the vertical surface to form an aperture in the vertical surface upon depression of at least one of said plurality of punches to install the article on the vertical surface thereby.

2. The device of claim 1 wherein said mounting plate includes a first side and a second side;

said adjusting means comprises a first and a second adjustment screw positioned at said first side and said second side of said second end of said mounting plate, respectively; and said first longitudinal member being positioned between said first and second adjustment screws such that in use upon rotation of each said adjustment screws in a first direction said first longitudinal member is abutted by each said adjustment screws thereby securing said mounting plate to said first longitudinal member and upon rotation of each said adjustment screws in second direction each of said adjustment screws in withdrawn from said first longitudinal member to enable said mounting plate to pivot about said first end for correcting said level relative to said horizontal surface and to slide along said first longitudinal member.

3. A measuring device as set forth in claim 1 wherein said retractable measuring device further includes:

a tape measure secured to said mounting plate;

said tape measure including:

a spindle;

a length of measuring tape having a first end secured to said spindle and an extendable end such that said tape is coiled around said spindle;

first biasing means for recoiling said tape from a first position in which said tape is extended away from said spindle to a second position in which said tape is recoiled around said spindle;

a finger-actuated locking means secured to said plate for locking said tape anywhere between said first and said second position;

said finger-actuated locking means includes a locking arm having a first and a second end, said arm being pivotally secured to said plate between said first and second ends of said arm;

a stop member rigidly secured to said plate adjacent to said first end of said arm;

second biasing means disposed adjacent to said second end of said arm for pivoting said first end of said arm into abutment against said stop member;

guide means disposed adjacent said first end of said arm for guiding said tape from said spindle between said stop member and said first end of said arm;

said guide means including a first and a second roller each having an axis of rotation which is spaced and parallel relative to each other such that said tape simultaneously engages said first and said second roller and extends between said rollers for guiding said tape in a first lateral direction when said tape passes around said first roller and in a second lateral direction opposite to said first direction when said tape passes around said second roller;

a reamer extending from each punch of said plurality of punches, with the end of each said reamer defining a cutter point;

said first and second rollers being positioned on said mounting plate such that the position of said tape between said first and said second rollers is in alignment with at least one said cutter point of said reamer extending from each said punch of said plurality of punches disposed in said frame such that in use said cutter point is aligned with the measurement indicated by said measuring tape between said first and said second rollers to ream a drape bracket support hole in the vertical support surface in vertical alignment with the measurement indicated by said measuring tape between said first and said second rollers; and said second end of said arm being finger-actuatable such that when said second end of said arm is pivoted against said second biasing means, said tape is extendable away from said spindle and when said second end of said arm is released, said second biasing means pivotally urges said first end of said arm against said tape to lock said tape between said stop member and said first end of said arm.

4. The device of claim 3 wherein said tape measure further includes:

an L-shaped member secured to said extendable end of said tape such that said L-shaped member enables said extendable end of said tape to be hooked over an edge of said vertical surface.

5. A device for installing an article on a vertical surface, said device comprising:

a base;
a first longitudinal member connected to said base;
a second longitudinal member slidable longitudinally relative said first member;
means for establishing said second longitudinal member in a telescopic relationship with said first longitudinal member enabling the distal end of said second longitudinal member to be varied in vertical height relative to said base;
a template frame secured to said second member;
a plurality of punches disposed in said frame;
a mounting plate having a first end and a second end with said first end being slidably and pivotally secured to said first longitudinal member;
a retractable measuring device connected to said mounting plate for measuring laterally relative to said first longitudinal member;
said retractable measuring device further includes:
a tape measure secured to said mounting plate;
said tape measure including:
a spindle;
a length of measuring tape having a first end secured to said spindle and an extendable end such that said tape is coiled around said spindle;
first biasing means for recoiling said tape from a first position in which said tape is extended away from said spindle to a second postion in which said tape is recoiled around said spindle;
a finger-actuated locking means secured to said plate for locking said tape anywhere between said first and said second position;
said finger-actuated locking means includes a locking arm having a first and a second end, said arm being pivotally secured to said plate between said first and second ends of said arm;
a stop member rigidly secured to said plate adjacent to said first end of said arm;
second biasing means disposed adjacent to said second end of said arm for pivoting said first end of said arm into abutment against said stop member;
guide means disposed adjacent said first end of said arm for guiding said tape from said spindle between said stop member and said first end of said arm;
said guide means including a first and a second roller each having an axis of rotation which is spaced and parallel relative to each other such that said tape simultaneously engages said first and said second roller and extends between said rollers for guiding said tape in a first lateral direction when said tape passes around said first roller and in a second lateral direction opposite to said first direction when said tape passes around said roller;
a reamer extending from each punch of said plurality of punches, with the end of each said reamer defining a cutter point;
said first and second rollers being positioned on said mounting plate such that the position of said tape betwen said first and said second rollers is in alignment with at least one said cutter point of said reamer extending from each said punch of said plurality of punches disposed in said frame such that in use said cutter point is aligned with the measurement indicated by said measuring tape between said first and said second rollers to ream a drape bracket support hole in the vertical support surface in vertical alignment with the measurement indicated by said measuring tape between said first and second rollers;
said second end of said arm being finger-actuatable such that when said second end of said arm is pivoted against said second biasing means, said tape is extendable away from said spindle and when said second end of said arm is released, said second biasing means pivotally urges said first end of said arm against said tape to lock said tape between said stop member and said first end of said arm;
a spirit level secured to said first end of said mounting plate for permitting in use the ascertainment and maintenance of the device in a vertical position; and
locking means for locking the relative position between said first and said second longitudinally extending members, enabling an operator to position said template frame a predetermined distance vertically above said base with said tamplate frame being located in contact with the vertical surface to form an aperture in the vertical surface upon depression of at least one of said plurality of punches to install the article on the vertical surface thereby.

6. A device for installing an article on a vertical surface, said device comprising:
a base;
a first longitudinal member connected to said base;
a second longitudinal member slidable longitudinally relative said first member;
means for establishing said second longitudinal member in a telescopic relationship with said first longitudinal member enabling the distal end of said second longitudinal member to be varied in vertical height relative to said base;
a template frame secured to said second member;
a plurality of punches disposed in said frame;
a mounting plate having a first end and a second end with said first end being slidably and pivotally secured to said first longitudinal member;
said mounting plate includes a first side and a second side;
a retractable measuring device conneted to said measuring plate for measuring laterally relative to said first longitudinal member;
a spirit level secured to said first end of said mounting plate for permitting in use the ascertainment and maintenance of the device in a vertical position;
an adjusting means for adjusting said level in order to correct said level for error such that in use said longitudinal members are vertically positioned on the vertical surface;
said adjusting means comprises a first and a second adjustment screw positioned at said first side and said second side of said second end of said mounting plate, respectively;
said first longitudinal member being positioned between said first and second adjustment screws such that in use upon rotation of each said adjustment screws in a first direction said first longitudinal member is abutted by each said adjustment screws thereby securing said mounting plate to said first longitudinal member and upon rotation of each said adjustment screws in a second direction each of said adjustment screws is withdrawn from said first end for correcting said level relative to said horizontal surface; and
locking means for locking the relative position between said first and said second longitudinally extending members, enabling an operator to position said template frame a predetermined distance vertically above said base with said template frame being located in contact with the vertical surface to form an aperture in the vertical surface upon depression of at least one of said plurality of punches to install the article on the vertical surface thereby.

* * * * *

UNITED STATES PATENT AND TRADEMARK OFFICE

CERTIFICATE OF CORRECTION

PATENT NO. : 4,791,731

DATED : December 20, 1988

INVENTOR(S) John Dickinson et al.

It is certified that error appears in the above-identified patent and that said Letters Patent is hereby corrected as shown below:

Column 3, line 36, delete "to".
Column 4, line 39, delete "frist" and insert therefor --first--.
Column 7, line 9, delete "squire" and insert therefor --square--.
Column 7, line 10, delete "provided" and insert therefor --prevented--.
Column 8, line 2, delete "finger-actuated" and insert therefor --finger-actuable--.
Column 8, line 15, delete "finger-actuated" and insert therefor --finger-actuable--.
Column 9, line 18, delete "insulation" and insert therefor --installation--.
Column 9, line 54, delete "103C" and insert therefor --130C--.
Column 11, line 64, delete "124C" and insert therefor --142C--.
Column 12, line 20, delete "57C" (second occurrence) and insert therefor --58C--.

In the Claims

Claim 2, column 13, line 64, delete "in" and insert therefor --is--.
Claim 5, column 15, line 50, after "said" (second occurrence) insert --second--.
Claim 6, column 16, line 50, after "and" insert --said--.

UNITED STATES PATENT AND TRADEMARK OFFICE

CERTIFICATE OF CORRECTION

PATENT NO. : 4,791,731

DATED : December 20, 1988

INVENTOR(S) : John Dickinson et al.

It is certified that error appears in the above-identified patent and that said Letters Patent is hereby corrected as shown below:

Claim 6, column 16, lines 57 and 58, add missing line -- longitudinal member to enable said mounting plate to pivot about said first --.

Signed and Sealed this

Twenty-seventh Day of February, 1990

*Attest:*

JEFFREY M. SAMUELS

*Attesting Officer*

*Acting Commissioner of Patents and Trademarks*